US005906421A

United States Patent [19]

Floyd

[11] Patent Number: 5,906,421

[45] Date of Patent: May 25, 1999

[54] SAFETY DEVICE FOR INHIBITING CHILD ACCESS TO A CABINET

[76] Inventor: Roger M. Floyd, 496 Wallace Rd., West Monroe, La. 71291

[21] Appl. No.: 08/914,566

[22] Filed: Aug. 19, 1997

[51] Int. Cl.[6] ..... E06B 9/15

[52] U.S. Cl. ..... 312/297; 160/28; 160/100; 312/138.1; 312/326

[58] Field of Search ..... 312/334.44, 334.46, 312/4, 138.1, 297, 326; 49/332; 160/28, 27, 100, 92, 99, 96, 97, 98, 102

[56] References Cited

U.S. PATENT DOCUMENTS

| | | | |
|---|---|---|---|
| 834,145 | 10/1906 | Landsberg | 160/98 |
| 1,204,833 | 11/1916 | Warfel | 160/97 |
| 1,479,312 | 1/1924 | O'Harrow . | |
| 1,653,788 | 12/1927 | Stein . | |
| 1,716,060 | 6/1929 | Hutchinson, Jr. | 160/98 |
| 2,311,413 | 2/1943 | Persson | 160/28 |
| 2,379,120 | 6/1945 | Turner | 160/27 |
| 2,406,761 | 9/1946 | Golkowski | 160/290 |
| 2,443,515 | 6/1948 | Rockwell | 312/138.1 X |
| 2,455,112 | 11/1948 | Christison | 160/32 |
| 3,012,806 | 12/1961 | Ellis | 292/288 |
| 3,059,952 | 10/1962 | Wittman et al. | 292/288 |
| 3,160,453 | 12/1964 | Tassell | 312/326 |
| 3,338,290 | 8/1967 | Servis | 160/238 |
| 3,378,950 | 4/1968 | Butler | 49/70 |
| 3,855,731 | 12/1974 | Yerkes | 49/70 |
| 4,103,458 | 8/1978 | Booker | 160/97 X |
| 4,969,291 | 11/1990 | Camara | 49/71 |

FOREIGN PATENT DOCUMENTS 340249 12/1930 United Kingdom .

*Primary Examiner*—Peter M. Cuomo
*Assistant Examiner*—Stephen Vu
*Attorney, Agent, or Firm*—Roy, Kiesel & Tucker

[57] ABSTRACT

The invention disclosed herein provides a safety device for inhibiting child access to a storage space. The safety device has a length of flexible material with a first end. The device also has a material retainer for storing the flexible material and allowing the flexible material to be retractably withdrawn from the material retainer. A first connecting member is attachable to the material retainer and a second connecting member is attachable to the first end of the flexible material. The first and second connecting members are positioned in the doorway of the storage space such that opening the door of the storage space withdraws the flexible material from the material retainer and extends the flexible material across the doorway. When a small child opens a storage space door on which the invention has been installed, the length of flexible material is drawn across the doorway of the storage space. The child's view of the interior of the storage space is blocked and the child's pressing against the flexible material results in the door tending to close, thereby further discouraging the child's access to the storage space.

17 Claims, 6 Drawing Sheets

SAFETY DEVICE FOR INHIBITING CHILD ACCESS TO A CABINET

BACKGROUND OF INVENTION

The present invention relates to safety devices intended to prevent or inhibit access by small children to cabinets and similar storage spaces. More particularly, the present invention relates to a device which blocks a child's physical access and his or her line of sight to the interior of the storage space and further biases the door of the storage space in a closed position. However, the present invention will not substantially interfere with an adult's access to the interior of the storage space.

It is a common experience that as infant children begin to crawl or walk, they become capable of opening doors on lower level storage spaces such as cabinets under kitchen sinks and the like. Since these storage spaces often contain items or substances that may be hazardous or deadly if mishandled or ingested, it is necessary to equip such storage spaces with devices that will prevent or inhibit the child's access. Typically these devices are formed of some type of latching mechanism that prevents the storage space door from being opened or only allows the door to be opened a slight amount. In order to fully open the door, the latch mechanism must be released. For example, one type of device is designed for use on twin door cabinets having loop type door handles. The device comprises a U-shaped member that is placed through the handle of both doors and a selectively releasable latch that slides over and locks onto the arms of the U-shaped member. The U-shaped member and latch bind the door handles together and thereby prevent the doors from opening. Such a device is manufactured by Brainerd Mfg. Co. of East Rochester, N.Y. Another type of device secures the cabinet door from with a latch positioned on the interior of the door. The device has an elongated latch arm that is connected to the cabinet door and extends into the cabinet when the door is closed. The end of the latch arm has a hook which engages a catch mechanism positioned in the interior of the cabinet. When the latch arm engages the catch mechanism, the cabinet door may only open a slight amount. The intention is that the door will not open enough for a child to access the interior, but will open enough for an adult to disengage the latch arm from the catch mechanism. Such a device is produced by Safety 1st Inc. of Chestnut Hill, Mass.

However, these latch devices have numerous disadvantages. First, many children quickly perceive how the latch mechanism operates and are scarcely hindered in gaining fall access to the storage space. Second, since many allow the door to partially open even before becoming unlatched, the child is allowed to see the contents of the storage space and may be inspired to even further efforts to gain access to the storage space. Third, the latch devices are often a hindrance to adults, requiring both hands to open a storage space door. Fourth, most of the latch devices require that the adult to remember to re-secure the latch device when finished accessing the storage space.

What is needed in the art is a child access inhibiting device which overcomes these disadvantages and provides a practical and cost efficient method of reducing the risk of injury and poisoning of infant children.

OBJECTS AND SUMMARY OF INVENTION

It is therefore an object of this invention to provide a safety device for inhibiting child access to a storage space which eliminates the need for conventional latching mechanisms.

It is another object to provide a safety device which will bias the door of the storage space in a closed position.

It is still another object to provide a safety device which will block a child's view of the interior of the storage space when the door is open and therefore will not incite the child's curiosity.

Therefore the present invention provides a safety device for inhibiting child access to a storage space. The safety device has a length of flexible material with a first end. The device also has a material retainer for storing the flexible material and allowing the flexible material to be retractably withdrawn from the material retainer. A first connecting member is attachable to the material retainer and a second connecting member is attachable to the first end of the flexible material. The first and second connecting members are positioned in the doorway of the storage space such that opening the door of the storage space withdraws the flexible material from the material retainer and extends the flexible material across the doorway.

DETAILED DESCRIPTION

Figure 1:
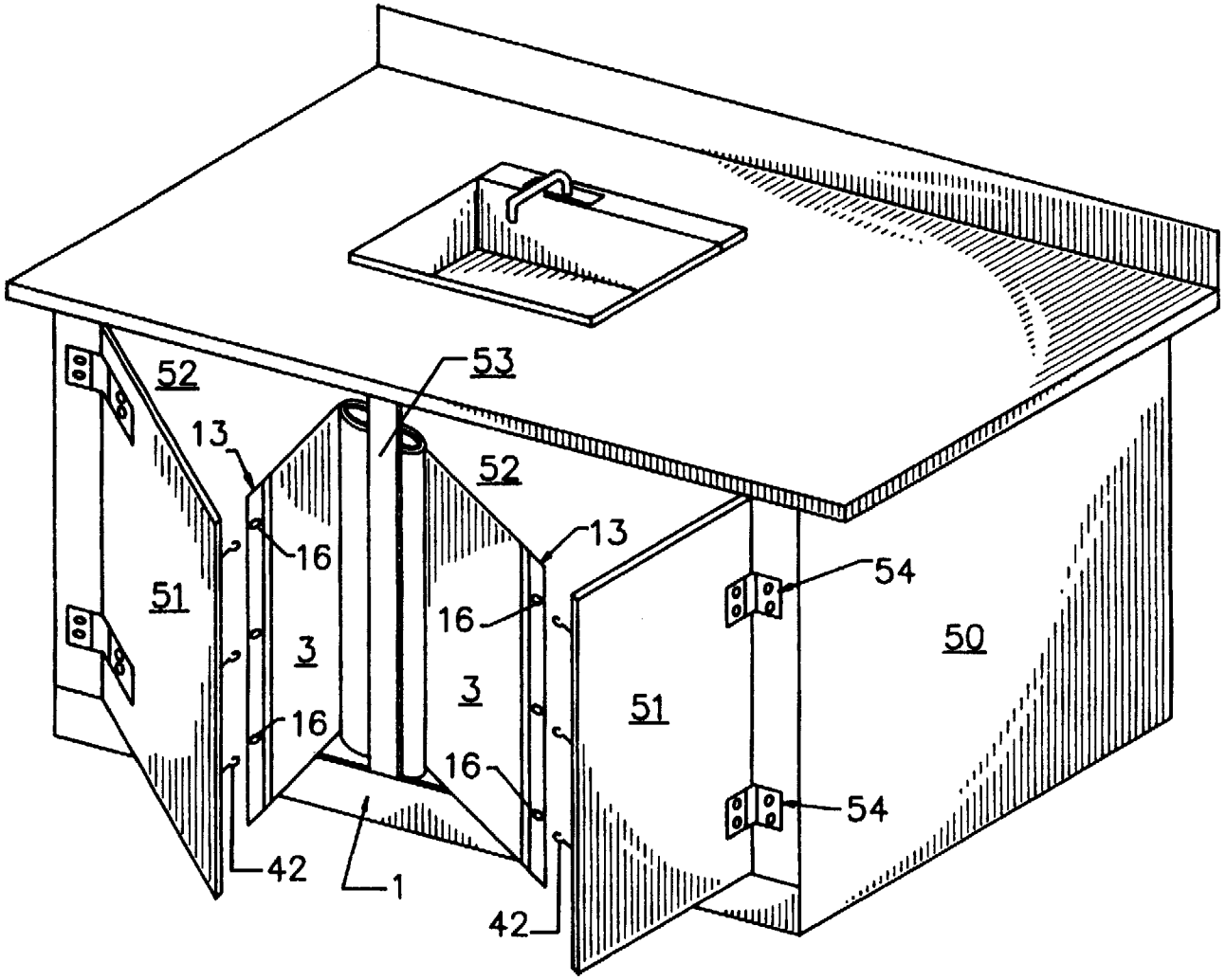
FIG. 1 is a perspective view of the present invention positioned in a conventional storage space or cabinet.

FIG. 1 illustrates the present invention, child safety device 1, mounted in a convention storage space or cabinet 50. Storage place 50 has doors 51 which are attached to storage space 50 by hinges 54 and which close against styling 53. When doors 51 are in the open position, a doorway 52 is formed between styling 53 and the section of storage place 50 to which hinges 54 are attached. While FIG. 1 illustrates a storage space with twin doors, the present invention is equally applicable to single door storage spaces. Where the specification discusses components attached to the styling 53 of twin door storage spaces, it will be understood that these components could also be attached to any corresponding part of the framing of a single door storage space. Therefore the term "frame" or "framing" may be used interchangeably with the term "styling" to denote the part of the storage space against which the door closes.

Figures 2A, 2B, 2C, 2D:
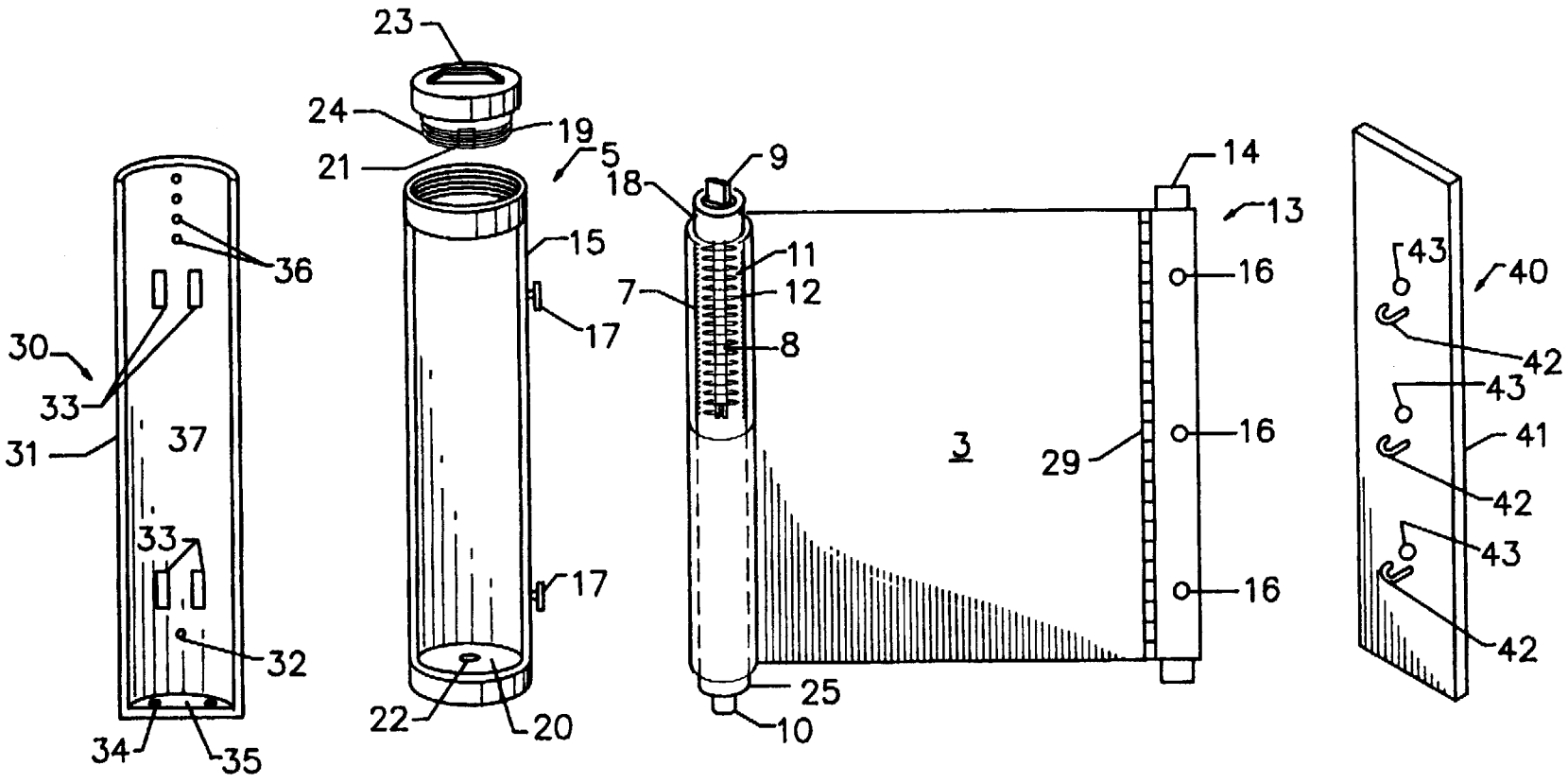
FIG. 2*a* is a perspective view of the first connecting member of the present invention.
FIG. 2*b* is a perspective view of the holding cylinder of the present invention.
FIG. 2*c* is a partial cut-away view of the flexible material mounted on the spool of the present invention.
FIG. 2*d* is a perspective view of the second connecting member of the present invention.

The various components comprising child safety device 1 are better seen in FIGS. 2*a*–2*d*. As seen in FIGS. 2*b* and 2*c*, a section of flexible material 3 will be mounted on a spool 7 which in turn will be positionable in a material holding cylinder 15. In the embodiment shown, the combination of flexible material 3, spool 7 and holding cylinder 15 will form material retainer 5 (seen assembled in FIG. 4). Viewing the cut-away section of FIG. 2c, an internal rod 8 will be positioned inside spool 7 and internal rod 8 will communicate through spool cap 18 with rectangular rod end 9. Spool cap 18 will be fixed to spool 7 and will be formed such that rod end 9 and internal rod 8 may rotate relative to spool cap 18 and spool 7. A biasing device 11 will be connected at between spool 7 and internal rod 8 in such a manner that relative rotation between spool 7 and internal rod 8 will cause biasing device 11 to exert a resisting torque on spool 7. In the embodiment shown, biasing device 11 is a conventional spring 12 whose first end is connected to the lower section of internal rod 8 with a second end connected to the internal surface of spool 7. Therefore when rod end 9 is fixed and spool 7 rotated, spring 12 is place under tension and will urge spool 7 to rotate back to its original position. The significance of this operation will be explained in greater detail below. The lower end of spool 7 has a spool cap 25 to which round rod end 10 is connected. However, in the embodiment shown, spool cap 25 and round rod end 10 are fixed to spool 7. It is not necessary for rod end 10 to rotate relative to spool 7 since rod end 10 is mainly intended to secure spool 7 within material retainer 5 as discussed below.

One end of flexible material 3 is attached to spool 7 (hidden from view in the Figures) with the excess length of flexible material 3 being rolled onto spool 7. The opposite end of flexible material 3, end 13, is seen in FIG. 2c. End 13 is attached to a stiffener 14 and has attaching apertures 16 formed through both flexible material 3 and stiffener 14. End 13 may be attached to stiffener 14 in any conventional manner. In the embodiment shown, end 13 is wrapped around stiffener 14 and flexible material 3 is attached to itself by a conventional heat seal 29 formed by melting the plastic-like flexible material 3 to itself. Of course, flexible material 3 could be attached to itself by any other conventional method, such as gluing or sewing. As further explained below, stiffener 14 will assist in attaching end 13 of flexible material 3 to the proper part of storage space 50. Flexible material 3 will typically be formed of vinyl or a similar flexible but comparatively strong substance, but could be formed of any material which functions for the purposes described herein. Additionally, in a preferred embodiment, flexible material 3 will be substantially opaque in order to block a child's view of the contents of storage space 50. Where the child cannot view the contents of the storage space, he or she will not be encouraged to gain access to the storage space. In order to block the child's view, it is preferred that the width of flexible material 3 be approximate to the height of doorway 52 of storage space 50. The standard height of a cabinet typically found in the home is 23 inches; therefore a preferred embodiment comprises a flexible material 3 that is from approximately 17 to 19 inches in width. Furthermore, the length of flexible material 3 stored on spool 7 may be approximately 66 inches in the embodiment shown. However, it is not strictly necessary that the width of flexible material 3 be in this range and any width that will sufficiently block the child's view of the interior of storage space 50 may be employed. Likewise, any length of flexible material 3 may used as long as it allows child safety device 1 to operate as intended.

Figure 4:
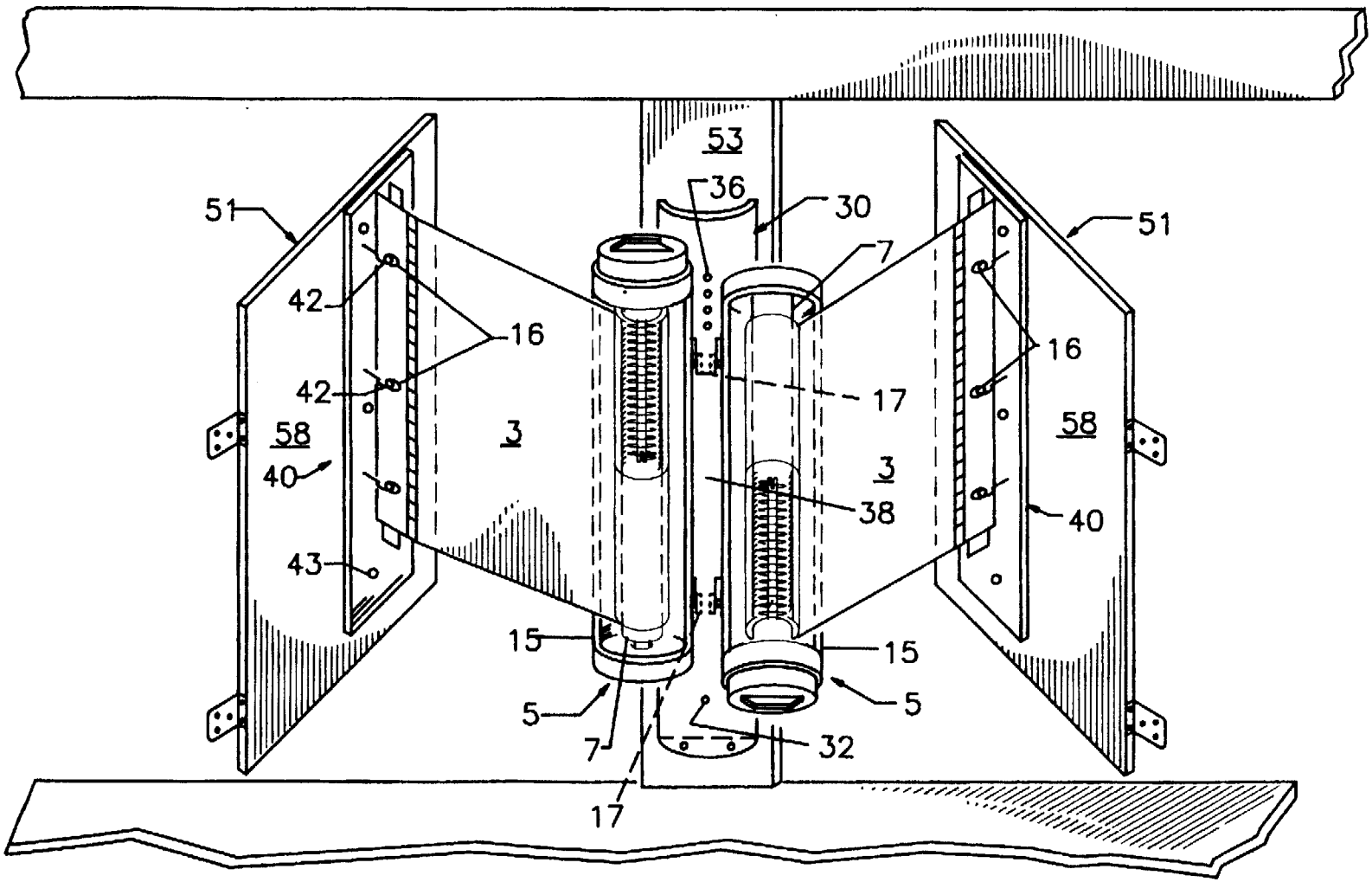
FIG. 4 is an assembled perspective view of the of the present invention as seen from the interior of a storage space.

As mentioned above, flexible material 3 is attached to spool 7 and will be positionable in material retainer 5. As seen in FIG. 2b, material retainer 5 comprises holding cylinder 15 with a section of the cylinder wall removed in order that flexible material 3 may extend out of holding cylinder 15 when spool 7 is positioned therein. Holding cylinder 15 will further have mounting lugs 17 whose function is to connect material retainer 5 to storage space 50 as is explained below. Holding cylinder 15 will also have end caps 19 and 20 which maintain spool 7 in holding cylinder 15. As illustrated, end cap 20 will have a round aperture 22 to receive round rod end 10 while end cap 19 will have a rectangular aperture 21 to receive rectangular rod end 9. End cap 19 will further have tightening knob 23 and threaded section 24. Since end rod end 9 engages aperture 21, rotation of end cap 19 will rotate end rod end 9 and place increased tension on spring 12, urging flexible material 3 to be winded onto spool 7 with greater force. It will be readily apparent that the greater the number of turns placed on rectangular rod end 9 and internal rod 8, the greater the tension on spring 12 since one end of spring 12 is attached to internal rod 8 and the other end to spool 7 as described above. In order to limit the tension placed on spring 12, end cap 19 will be given a limited number of threads on threaded section 24 such that only a given number of turns will be imparted to end cap 19 before it is secure on holding cylinder 15 and will turn no further. Therefore a preset number of threads on end cap 19 will allow a proper amount of tension to be placed on spring 12. This amount of tension will be sufficient to firmly close door 51, but not so great that door 51 will close with a high velocity which would injure a hand or other body part if the door should close thereon. When spool 7 is placed within holding cylinder 15, end 13 of flexible material 3 may extend through the opening in holding cylinder 15 as seen in FIG. 4. Since aperture 21 on end cap 19 engages rectangular rod end 9, rod end 9 is held stationary during operation when flexible material 3 is drawn out causing spool 7 to rotate. On the other hand, rod end 10 is free to rotate in aperture 22 and will rotate with spool 7 when torque is applied to spool 7. In the embodiment shown, end cap 20 threadedly engages holding cylinder 15. However, it is not strictly necessary that end cap 20 be removable from holding cylinder 15. It is an acceptable alternative for end cap 20 to be fixedly attached on holding cylinder 15 or to be formed as an integral part of holding cylinder 15.

Figure 5:
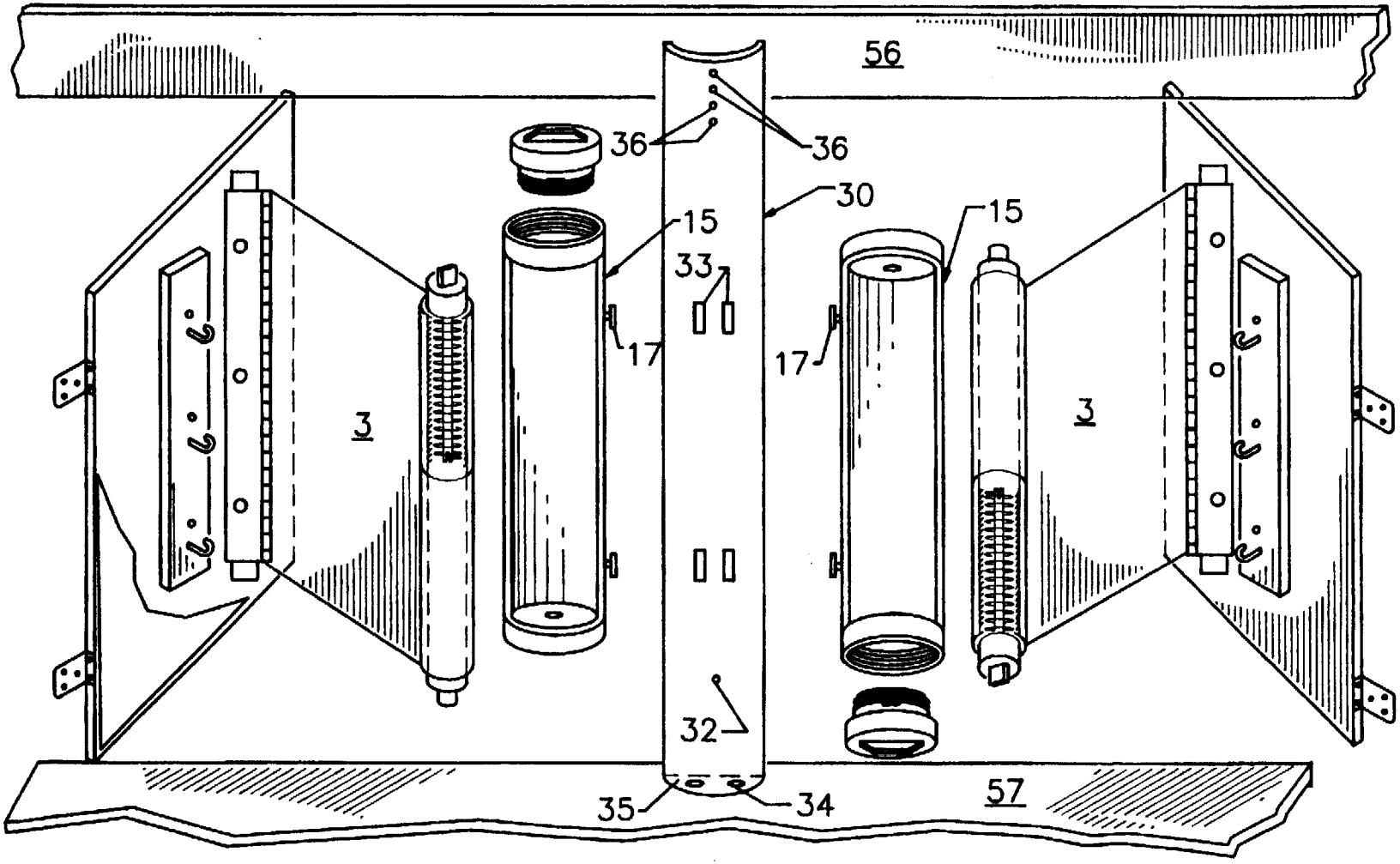
FIG. 5 is an exploded perspective view illustrating an alternate embodiment of the first connecting member of the present invention.

FIG. 2a illustrates the means by which material retainer 5 will be positioned in storage space 50. First connecting member 30 comprises a half cylindrical body 31 with the concave inner surface 37 facing the viewer of FIG. 2a. A footing 35 is formed on the bottom end of the body 31. Footing 35 will have at least one footing aperture 34 (with two shown in the Figures) formed therein. Footing 35 and footing apertures 34 will allow first connecting member 30 to be secured to the floor of storage space 50 when nails, screws, or similar attachment means are passed through apertures 34 into the floor 57 of storage space 50 as seen in FIG. 5 and explained below. Adjacent to the upper end of body 31, a plurality of apertures 36 will be formed through the wall of body 31. Apertures 36 will allow first connecting member 30 to be attached to either styling 53 (see FIG. 4) or an upper horizontal member 56 (see FIG. 5). When attached to an upper horizontal member 56, the multiple apertures 36 spaced at varying heights will allow first connecting member 30 to accommodate variations in the height of upper horizontal member 56 which may occur among nonstandard storage spaces 50. An aperture 32 will also be formed approximate the lower end of first connecting member 30 and will operate to secure first connecting member 30 to styling 53. Generally, aperture 32 will be used in place of footing aperture 34 when the storage space 50 has a styling 53 to which first connecting member 30 may be attached. Returning to FIG. 2*a*, body 31 will also comprise a plurality of lug receiving slots 33 which are adapted to receive attaching lugs 17. In the embodiment seen in FIG. 2*a*, body 31 includes four lug receiving slots 33 in order for first connecting member 30 to hold two material retainers 5 as seen in FIG. 4. Those skilled in the art will readily recognize that when attaching lugs 17 pass through receiving slots 33, a downward movement of cylinder body 15 will lock attaching lugs into first connecting member 30 as shown by the dashed lines in FIG. 4.

Figure 3:
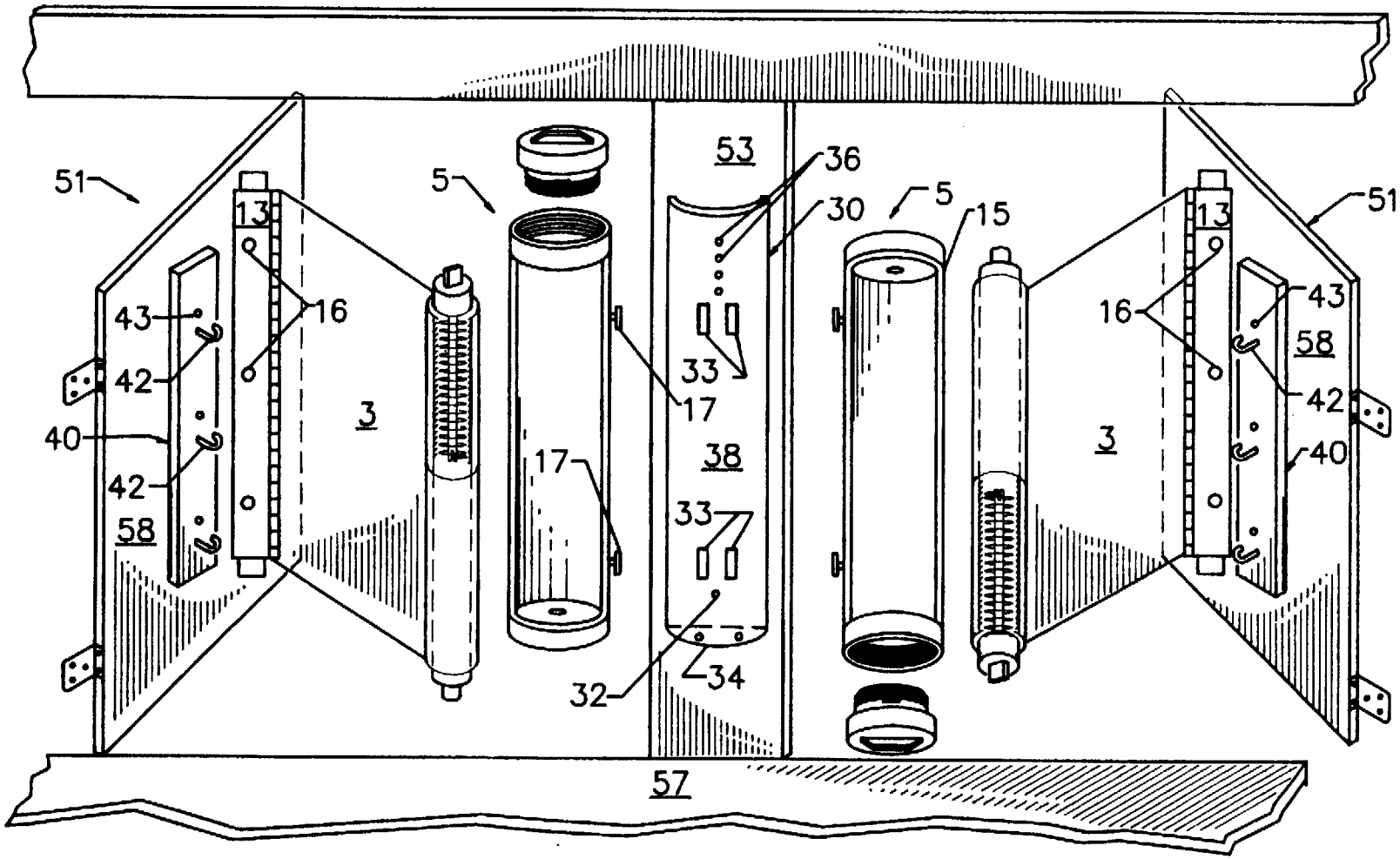
FIG. 3 is an exploded perspective view of the of the present invention as seen from the interior of a storage space.

FIG. 2*d* illustrates a second connecting member 40 which will attach to the inner surface 58 of storage space door 51 as seen in FIGS. 3 and 4. This embodiment of second connecting member 40 includes a planar body section 41 having a plurality of apertures 43. While this embodiment will generally employ screws passing through apertures 43 to secure body section 41 to door 51, the scope of the invention includes any and all alternate means of securing body section 41 to door 51. A plurality of connecting hooks 42 will extend from body section 41 in order to attach end 13 of flexible material 3 to door 51 as suggested in FIG. 1. Again, hooks 42 are only illustrative of one device for attaching end 13 to second connecting member 40. While the illustrated embodiments of first connecting member 1 utilizes lug receiving slots 33 to grip material retainer 5 and second connecting member 40 uses hooks 42 to grip end 13 of flexible material 3, the present invention includes all alternate ways of attaching end 13 of material retainer 5 and attaching flexible material 3 in the doorway 52 of storage space 50. Although not as preferred, material retainer 5 could be semi-permanently fixed to styling 53 by nails, screws, glue or any other conventional attachment means. Similarly, end 13 of flexible material 3 could be fixed to door 51 by like means.

In operation, child safety device 1 will be mounted to the storage space 50 as illustrated in FIG. 1 (an exterior view of storage space 50) and in FIGS. 3–6 (interior views of storage space 50). The purpose for first connecting member 30 comprising a half cylinder is best understood by viewing FIG. 4. The curved outer surface 38 of connecting member 30 allows two material retainers 5 to be connected thereto. If first connecting member 30 provided a flat or planar outer surface, first connecting member 30 would have to be much wider to accommodate two material retainers 5 and could not be hidden behind the styling 53 of many conventional storage spaces 50. Still viewing FIG. 4, material retainer 5 is first secured to storage space 50 by first connecting member 30. With spool 7 positioned in cylinder 15, first end 13 of flexible material 3 will be drawn away from cylinder 15 and extended to doors 51. Thereafter apertures 16 will be connected to hooks 42 on second connecting member 40. As previously described, second connecting member 40 will be attached to an inner surface 58 of door 51.

When door 51 is opened, flexible material 3 will be withdrawn from material retainer 5 and extend across the doorway 52 as seen in FIG. 1 from the exterior of storage space 50 and as seen in FIG. 4 from the interior of storage space 50. This does not inhibit adults from reaching over and behind flexible material 3 in order to retrieve containers in storage space 50. To begin with, the open space formed between the top edge of door 51 and the top edge of flexible material 3 is the space through which a stooping adult typically removes objects from a lower level storage space 50. Secondly, if the existing opening between flexible material 3 and doorway 52 is not large enough to accommodate an oversized object being removed, the object can be moved against flexible material 3 and more flexible material 3 will easily be withdrawn from material retainer 5, thereby increasing the opening through which the oversized object may be withdrawn. After retrieving the object sought, the adult need not remember to close door 51. Since biasing device 11 is applying torque to spool 7 and urging flexible material 3 to be drawn into material retainer 5, flexible material 3 applies a force on door 51 which moves door 51 to a closed position.

However, when a small child opens door 51, the child from his or her eye-level only sees flexible material 3. Since flexible material 3 will generally be substantially opaque, the child's line of sight to the storage space contents is blocked. Therefore the present invention tends to prevent the child's curiosity from exciting further exploration of the storage space. However, should the child persist, pressing against flexible material 3 will only tend to further bias door 51 to the closed position. At any point when the child is not blocking door 51 open, door 51 will completely close under the tension of flexible material 3, thereby further frustrating the child's efforts to open the storage space doors. Thus safety device 1 presents a substantial deterrence to the child's desire to access the contents of the storage space 50.

On the other hand, when an adult needs to access the full doorway 52 of storage space 50, such as a plumber making repairs to piping under the sink, safety device 1 can be readily removed. It is only necessary to unhook apertures 16 on end 13 of flexible material 3 from hooks 42 and allow flexible material 3 to be retracted into material retainer 5. If material retainer 5 is itself considered to be a hindrance, it may removed simple by disengaging attaching lugs 17 from lug receiving slots 33. When the work is completed, safety device 1 may be easily and quickly repositioned in storage space 50.

It will be understood that the embodiment seen in FIG. 1 discloses only one preferred apparatus for carrying out the present invention and innumerable variations come within the scope of the present invention. For example, material retainer 5 need not be attached to a styling 53 as shown in FIG. 1. Many cabinets will not have a styling or other vertical member between two doors 51. FIG. 5 illustrates how in such cases, first connecting member 30 will be fixed in an upright position in storage space 50. The lower section of first connecting member 30 will be fixed to the floor 57 of storage space 50 by screws engaging apertures 36 of footing 35. Similarly, the upper section of first connecting member 30 will be fixed to horizontal member 56 framing door 51 by screws engaging apertures 36. Naturally, attaching means other than screws could be utilized.

Figure 6:
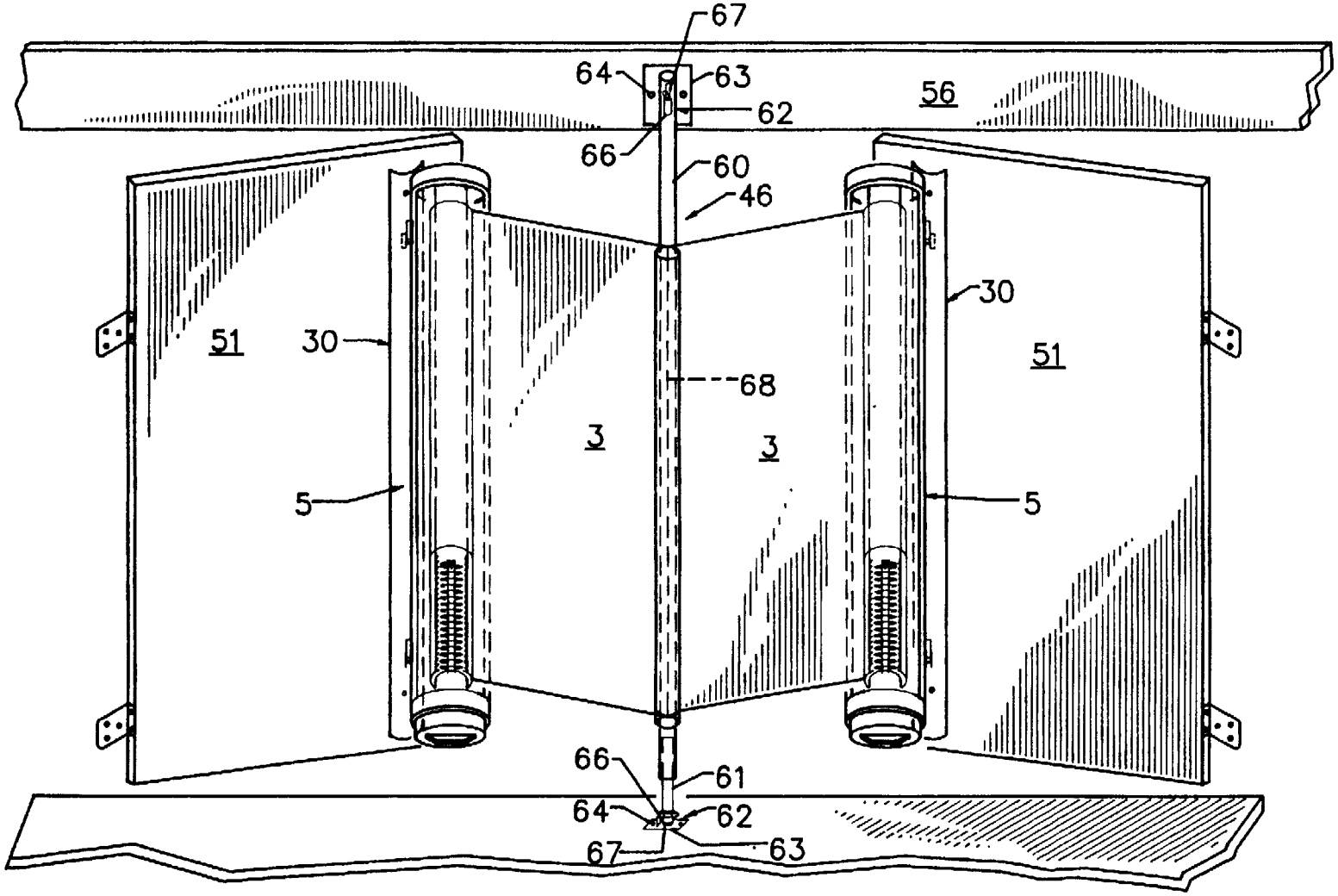
FIG. 6 is a perspective view of an alternate manner of installing the present invention in a storage space.

Another alternate embodiment can be seen in FIG. 6. In this embodiment, first connecting member 30 and material retainer 5 are fixed directly on door 51. The second connecting member 46 will be positioned in storage space 50 adjacent to the frame against which door 51 closes. The illustrated embodiment of connecting member 46 comprises an main rod 60 and a telescoping lower rod 61 which slidingly engages the tubular lower end of main rod 60. Main rod 60 is shown attached to horizontal member 56 of storage space 50 by way of a brace 63. Brace 63 has apertures 64 through which screws, nails or similar attaching means will pass in order to secure brace 63 to horizontal member 56. In the embodiment shown, main rod 60 will have an aperture 66 formed therein and brace 63 will have a pinning device or hook 67 which will pass through this aperture 66 in order to secure main rod 60 to brace 62. The same pinning method is employed to attach lower rod 61 to its respective brace 63. The aperture 66 and pinning device 67 allow second connecting member 46 to be removably attached to storage space 50 such that second connecting member 46 may be easily removed when it is necessary to create the largest possible open space in the doorway 52. FIG. 6 further illustrates how this embodiment will utilize a single continuous length of flexible material 3 extending between the two material retainers 5. In this embodiment, the length of flexible material 3 will be attached to second connecting member 46 by simply folding or wrapping flexible material 3 around second connecting member 46 and attaching flexible material 3 to itself by any convention means, including heat sealing or sewing. The seam of this attachment is represented by dashed line 68 in FIG. 6. It is envisioned that an appropriate length of flexible material 3 in this embodiment will be approximately 21 inches of flexible material 3 stored in each material retainer 5. However, any length of flexible material 3 which allows child safety device 1 to function as intended comes within the scope of this invention.

Nor are first and second connecting members 30 and 40 limited to the embodiments shown. First connecting member 30 could comprise any means of attaching retaining device 5 to storage space 50 or door 51. For example, screws, bolts or other devices attaching retaining device 5 directly to the framing of storage space 50 or door 51 are considered first connecting members 50 for the purposes of this invention. Similarly, any means of fixing end 13 of flexible material 3 to the framing of storage space 50 or door 51, whether the means be screws, nails, or adhesive materials, such means should be considered within the definition of second connecting member 40.

Of course, the foregoing disclosure and description of the invention are only illustrative and explanatory thereof, and various changes in the size, shape and materials as well as in the details of the illustrated construction may be made without departing from the intended scope and spirit of the invention. All such variations are considered within the scope of the present invention as defined by the following claims.

I claim:

1. A storage space cabinet for inhibiting child access therein, said storage space cabinet comprising:

a. two doors, each of said doors having a first side pivotally connected to said storage space cabinet and a second side closing against a frame of said storage space cabinet;

b. a first connecting member positioned at an approximate midpoint between said doors within said storage space cabinet and having attachment devices formed thereon;

c. a first and second material retainer positioned on said first connecting member, each of said material retainers having a length of flexible material with a first end and each of said material retainers allowing said flexible material to be retractably withdrawn from said retainer; and d. a second connecting member positioned on each door of said storage cabinet, each of said second connecting members being attached to one of said first ends of flexible material, wherein said first and second connecting members are adapted to position said material retainer vertically within said storage space cabinet, and said flexible material has sufficient width to substantially cover said doorway and block a frontal view of an interior of said storage space cabinet.

2. A storage space for inhibiting child access according to claim 1, wherein said flexible material has a width approximating the height of a standard doorway of a storage space.

3. A storage space for inhibiting child access according to claim 1, wherein said flexible material is biased to be drawn within said material retainer and thereby bias said door of said storage space in a closed position.

4. A storage space for inhibiting child access according to claim 1, wherein said flexible material is substantially opaque.

5. A storage space for inhibiting child access according to claim 1, wherein said first connecting member has ends adapted to secure said first connecting member in a vertical position within said storage space.

6. A storage space cabinet for inhibiting child access according to claim 1, wherein said attachment device of said first connecting member comprises lug receiving apertures formed therein.

7. A storage space for inhibiting child access according to claim 6, wherein said first connecting member has a concave shape.

8. A storage space for inhibiting child access according to claim 1, wherein said first connecting member has a foot adapted for attachment to a floor of said storage space.

9. A storage space cabinet for inhibiting child access according to claim 1, wherein said first connecting member comprises a single element.

10. A storage space cabinet for inhibiting child access therein, said storage space cabinet comprising:

a. two doors, each of said doors having a first side pivotally connected to said storage space cabinet and a second side closing against a frame of said storage space cabinet;

b. a first connecting member positioned on each of said doors of said storage space cabinet and having attachment devices formed thereon;

c. a material retainer attached to each of said first connecting members, each of said material retainers having a length of flexible material and each of said material retainers allowing said flexible material to be retractably withdrawn from said retainer; and d. a second connecting member positioned at an approximate midpoint between said doors within said storage space cabinet and having said flexible material attached to said second connecting member wherein said first and second connecting members are adapted to position said material vertically within said storage space cabinet, and said flexible material has sufficient width to substantially cover said doorway and block a frontal view of an interior of said storage space cabinet.

11. A storage space cabinet for inhibiting child access according to claim 10, wherein a continuous length of flexible material is attached between said material retaining devices with said length of flexible material being attached at an approximate midpoint to said second connecting member.

12. A storage space for inhibiting child access according to claim 10, wherein said flexible material is substantially opaque.

13. A storage space cabinet for inhibiting child access according to claim 10, wherein said flexible material has a width approximating the height of a standard doorway of a storage space cabinet.

14. A storage space cabinet for inhibiting child access according to claim 10, wherein said flexible material is biased to be drawn within said material retainer and thereby bias said door of said storage space cabinet in a closed position.

15. A storage space cabinet for inhibiting child access according to claim 10, wherein said attachment device of said first connecting member comprises lug receiving apertures formed therein.

16. A storage space cabinet for inhibiting child access according to claim 10, wherein said first connecting member has a concave shape.

17. A storage space cabinet for inhibiting child access according to claim 10, wherein said second connecting member comprises a single element.

* * * * *